United States Patent [19]

Kusmer

[11] 4,149,715

[45] Apr. 17, 1979

[54] METHOD OF EXERCISING EMPLOYING A LEVER AGAINST A VARYING FORCE RESISTANCE

[76] Inventor: Kasimir C. Kusmer, 1021 Cochran St., Aurora, Ill. 60506

[21] Appl. No.: 698,805

[22] Filed: Jun. 23, 1976

Related U.S. Application Data

[60] Division of Ser. No. 594,367, Jul. 9, 1975, Pat. No. 4,023,796, and a continuation-in-part of Ser. No. 497,714, Aug. 15, 1974, Pat. No. 3,937,462.

[51] Int. Cl.[2] ..... A63B 21/02

[52] U.S. Cl. ..... 272/116; 272/142; 272/136; 272/DIG. 4; 272/67; 272/96

[58] Field of Search ..... 272/135, 141, 142, 136, 272/135, 130, 116, 134

[56] References Cited

U.S. PATENT DOCUMENTS

| | | | |
|---|---|---|---|
| 1,189,396 | 7/1916 | Sheridan | 272/141 |
| 3,563,542 | 2/1971 | Wellman | 272/135 |
| 3,567,219 | 3/1971 | Foster | 272/135 |

*Primary Examiner*—Richard C. Pinkham
*Assistant Examiner*—William R. Browne
*Attorney, Agent, or Firm*—Larson, Taylor and Hinds

[57] ABSTRACT

An exercising method which employs the principle of isotonic exercise in conjunction with isometric impact exercise. The exercising method comprises the steps using at least one lever to which the operator applies a rotational force against an adjustable resilient force, such as a spring, selectively opposing the rotation of the lever; suddenly removing the spring from opposing engagement with the lever after a predetermined amount of lever rotation, thereby permitting the lever to be rapidly rotated by the previously applied force; and suddenly stopping the rapidly rotating lever. The method further comprises sequentially repeating the above steps.

10 Claims, 13 Drawing Figures

FIG. 1
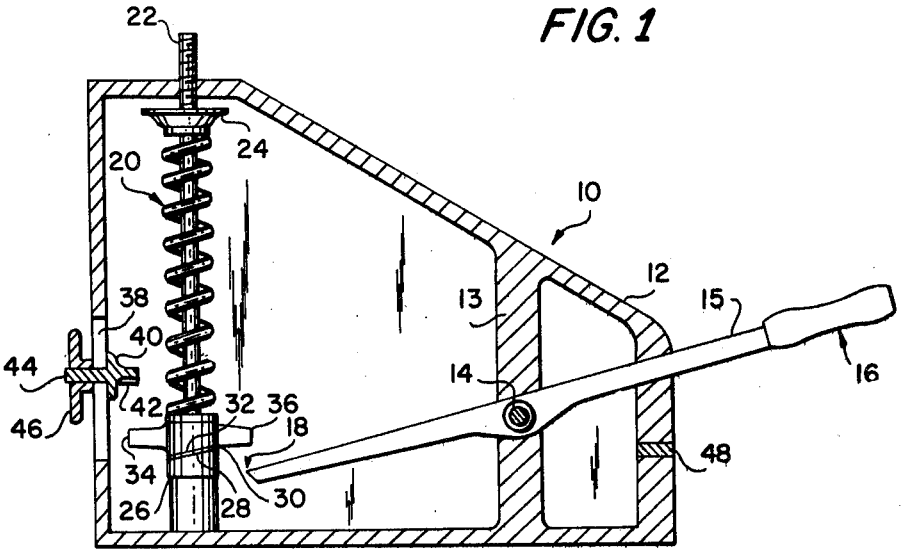
FIG. 2
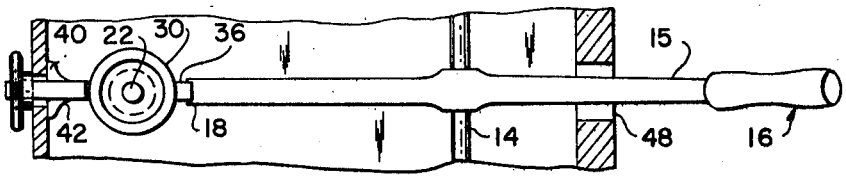
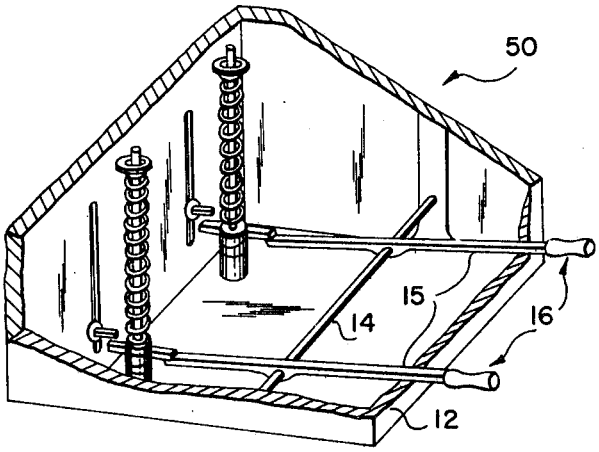
FIG. 3

METHOD OF EXERCISING EMPLOYING A LEVER AGAINST A VARYING FORCE RESISTANCE

CROSS-REFERENCE TO RELATED APPLICATIONS

This application is a continuation in part of Ser. No. 497,714 filed Aug. 15, 1974, now U.S. Pat. No. 3,937,462 and is a division of Ser. No. 594,367, filed July 9, 1975, now U.S. Pat. No. 4,023,796.

BACKGROUND OF THE INVENTION

1. Field of the Invention

The present invention relates generally to an exercising method and more particularly to a method employing a lever for exercising the limbs using a combination isometric and isotonic exercise.

2. Description of the Prior Art

Exercising apparatus which employ either isotonic exercise or isometric exercise are well known and conventional. Examples of isometric impact exercise devices in the prior art include conventional punching bags and the like, which permit exercise in the form of an impact to the operator. Other impact devices include the type utilizing a movable object constrained with a frame which is held by the operator. The impact is realized when the moving object strikes the frame and is transmitted to the operator. Devices of this type are disclosed in U.S. Pat. Nos. 2,871,017 and 3,545,121.

Isotonic exercise apparatuses are of the type which usually incorporate force resisting devices in the form of springs or suspended weights. Examples of this type of apparatus include the conventional barbell, elastic stretch devices similar to that disclosed in U.S. Pat. No. 3,662,602, and various static exercise devices of the type disclosed in U.S. Pat. Nos. 3,690,655 and 3,598,405.

However, there are very few, if any, exercising apparatuses in the prior art which combine both isotonic exercise and isometric impact exercise in a single device. In addition, many of the singular variety of exercising devices are expensive, too large for small apartments, not easily transported, and usually not adjustable.

SUMMARY OF THE INVENTION

The method of the present invention provides a unique exercising method to develop and strengthen the musculate and bone structure of the limbs. The method combines isometric impact exercising with isotonic exercising in order to obtain the benefits of both types of exercise. More particularly, the present method includes using a lever operable against a force resisting means up to a predetermined force whereupon the lever is released from the force resisting means and allowed to travel freely until it engages a travel restricting means which impedes the travel of the lever. The operation of the lever against the force resisting means provides a period of isotonic exercise which is followed by the operation of the lever against the travel restricting means which provides a period of isometric impact exercise. In one embodiment of the invention, the strength of the force resisting means and the point of lever disengagement can be adjusted thereby making both the strength and the duration of the isotonic exercise variable. Similarly, the period of free travel and the elasticity of the travel restricting means could be adjustable thereby making the strength and duration of the isometric impact exercise variable. In another embodiment of the invention, the method comprises operating a pair of cooperating levers jointly against the same force resisting means, thereby providing exercises to both limbs of the body simultaneously.

The method according to the present invention further comprises sequentially repeating the isotonic exercise followed by the isometric impact exercise obtained by using a device in accordance with the invention.

It is therefore an object of the invention to provide an improved method that can employ an apparatus, which although simple in construction, permits the user to exercise and develop the extremities of the body through the combination of isometric impact exercise with isotonic exercise. While the method is designed primarily to exercise the limbs of the body, in doing so it will tend to strengthen and develop other parts of the human body such as the thorax or the abdomen.

A further object of the present invention is the provision of an exercise method which may be used in limited quarters and which is simple and inexpensive.

These and other objects and advantages of the present invention will be discussed in, or apparent form, a consideration of the presently preferred embodiments set forth in the specification and claims hereinbelow.

BRIEF DESCRIPTION OF THE DRAWINGS

In the drawings:

FIG. 1 is a side elevational view of one embodiment of an exercising machine in accordance with the invention. FIG. 2 is a fragmentary plan view of a trip mechanism used to release the lever from the force resisting spring.

FIG. 3 is a perspective view of a dual lever embodiment of an exercising machine in accordance with the invention, used to exercise both arms or both legs.

DETAILED DESCRIPTION OF PREFERRED EMBODIMENTS

Figure 4:
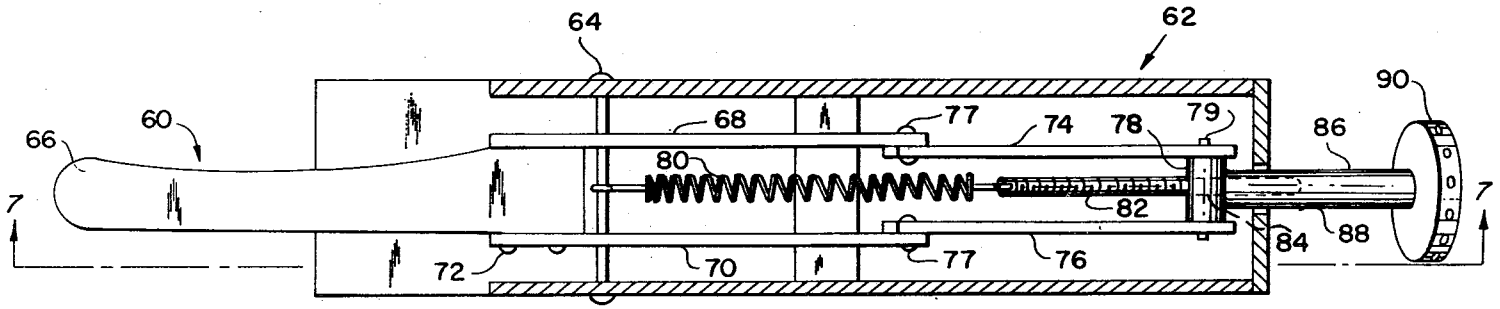
FIG. 4 is a top plan view of a further embodiment of an exercising machine in accordance with the invention.

Referring now to the drawings and particularly to FIGS. 1 and 2 thereof, there is shown an exercising machine generally designated 10 in accordance with the invention. Exercising machine 10 includes an elongated skeleton frame 12 having an inner vertical support member 13 extending between the top and bottom of frame 12. Pivotably attached to the mid portion of support member 13 at a pivot point or fulcrum 14 is a first class lever 15. One end of lever 15 extends longitudinally beyond frame 12 and has a handle 16 rigidly mounted thereon. The other end, denoted 18, of lever 15 terminates with a vertically inclined beveled surface located on the underside thereof.

Exercising machine 10 further includes an adjustable force resisting means such as a coil compression spring 20 concentrically mounted on a vertical supporting rod 24 which in turn is mounted on frame 12 proximate to end 18 of lever 15. The upper end of rod 22 is threaded and carries a pressure adjusting nut 24 which engages the upper end of spring 20 and can be positioned to increase or decrease the compression of spring 20. The other end of rod 22 has a collar 26 integrally mounted thereon and provided with a vertically inclined beveled surface 28. Concentrically mounted on rod 22 for rotational and axial movement is a cam 30, the lower end of which is provided with a beveled surface 32 which mates with and slidably engages beveled surface 28 of collar 26. The bottom of spring 20 engages with the upper surface of cam 30 so that upon axial movement of cam 30, spring 20 is compressed against the pressure adjusting nut 24.

Cam 30 also comprises a forward boss 34 and a rearward boss 36 extending substantially coaxially in a forward and rearward direction respectively. Rearward boss 36 extends rearwardly a sufficient amount so that it can be engaged with end 18 of lever 15 and upon rotation of lever 15 about fulcrum 14 will be raised axially upwardly thereby compressing spring 20.

The forward end of frame 12 is provided with a vertical slot 38 and a dog 40 rigidly mountable and vertically adjustable within slot 38. Dog 40 comprises a rearwardly extending portion 42, a forwardly extending screw portion 44 integral with portion 42, and a mounting nut 46. Portion 42 of dog 40 is provided with a vertically beveled plane for engaging a contra-beveled plane on boss 34 of cam 30 when cam 30 is vertically lifted to the height of dog 40.

At the rearward end of frame 12 is an impact block 48 integrally mounted on frame 12 at a vertical height not greater than the height of fulcrum 14. Impact block 48 extends in a transverse direction a distance sufficient so as to prevent any downward movement of lever 15 beyond the vertical height of block 48. In the embodiment depicted in FIG. 1, the vertical height of impact block 48 is the same as the vertical height of fulcrum 14 so that lever 15 will be substantially horizontal when it engages impact block 48.

In operation, exercising machine 10 is actuated by pressing in a downward direction against handle 16, thereby rotating lever 15 about fulcrum 14 in a clockwise direction. End 18 of lever 15 engages rearward boss 36 of cam 30 and upon continued clockwise rotation of lever 15 displaces cam 30 upwardly against the compressional force of spring 20. Eventually, as cam 30 is moved vertically upward about rod 22, forward boss 34 will engage dog 40 and continued upward movement of cam 30 will cause rotation thereof through the action of the contra-beveled surfaces on forward boss 34 and portion 42 of dog 40. At the point where cam 30 has been rotated sufficiently to disengage from end 18 of lever 15, the resisting force of the spring is removed and lever 14 is rapidly rotated downwardly until it engages with a sudden impact on impact block 48. This impact is transmitted to the operator through handle 16. As mentioned above, the compression of spring 20 can be adjusted with pressure adjusting nut 24 creating, for a greater compression, a greater impact delivered to the operator when lever 15 strikes impact block 48. In addition, the amount of free travel of lever 15 can be adjusted by the vertical positioning of dog 40 in a slot 38. Therefore, it can be seen that any combination of compression force and impact force can be obtained by varying the compression of spring 20 and the vertical travel of lever 15 after disengagement with cam 30.

Once lever 15 has been disengaged from cam 30, it can be easily reset by rotating handle 16 in an upward direction. When end 18 of lever 15 engages the upper portion of rearward boss 36, the cam surface on end 18 will rotate cam 30 out of engagement therewith, thereby permitting end 18 to be positioned below cam 30. If desired, rearward boss 36 of cam 30 can be provided with a vertical contra-beveled surface to the beveled surface of end 18. Thus by sequentially repeating the operation of exercising machine 10, the operator can use the isotonic exercise and isometric impact exercise to improve and develop the muscular and bone structure of the particular limb being exercised. As the muscular and bone structure becomes strengthened after repeated usage of exercising machine 10, the resistance of spring 20 can be increased, thereby providing further challenging exercise.

FIG. 3 depicts a two lever exercising machine 50 in accordance with the present invention. Each lever system of exercising machine 50 is identical to single lever exercising machine 10 and therefore exercising machine 50 need not be described in greater detail.

Figure 5:
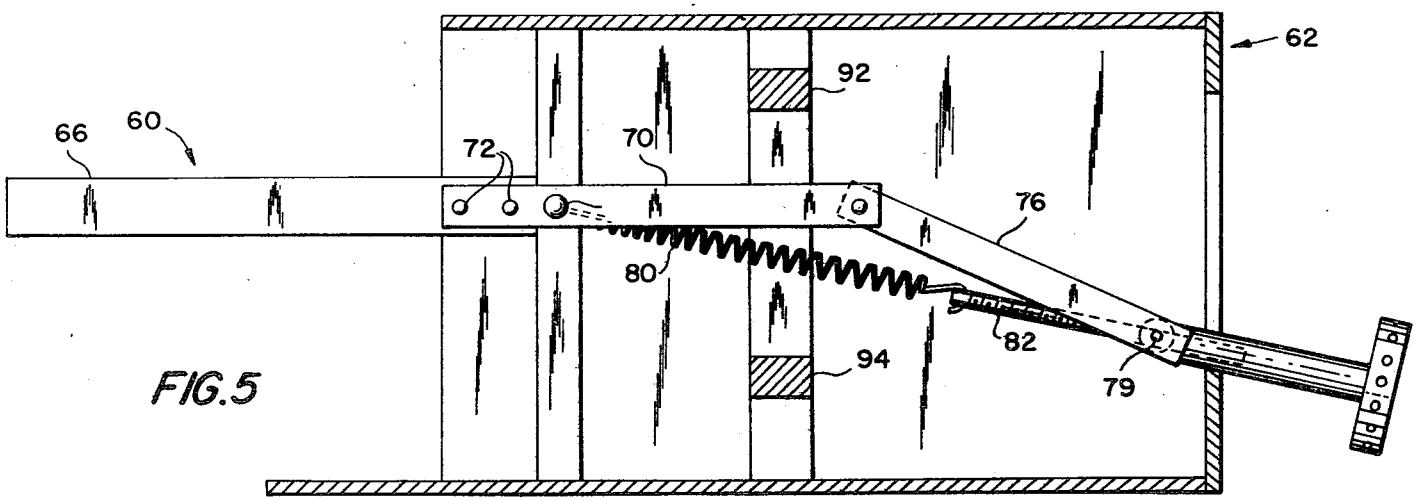
FIG. 5 is a side elevation view of the embodiment shown in FIG. 4.

A further embodiment of the present invention also employing a first class lever is depicted in FIGS. 4 and 5. A bifurcated lever 60 is pivotably mounted at a middle portion thereof to a frame 62 by a pin 64. Lever 60 comprises a handle 66, and two elongated members 68 and 70 ridigly mounted in a parallel arrangement to one end of handle 66 with bolts 72. Two connecting links 74 and 76 are pivotably mounted at pivot points 77 at one end thereof to members 68 and 70 respectively and are pivotably mounted to a crossbar 78 at the other end at a pivot point 79. The adjustable force resisting means comprises a coil spring 80 removably connected at one end to pin 64 and removably connected at the other end to a longitudinally extending threaded rod 82. Rod 82 extends through a longitudinally extending bore 84 in crossbar 78 and is threaded into an internal bore 86 in a tension adjusting bolt 88. Bolt 88 is slidably mounted in frame 62 and abuts crossbar 78 at one end. The other end of bolt 88 includes a knurled knob 90.

Located above members 68 and 70 of lever 60 is a first impact block 92 which is supported by frame 62. Impact block 92 is struck by lever 60 upon the counterclockwise rotation thereof. Located vertically below impact block 92 is a second impact block 94 which is struck by members 68 and 70 on the clockwise rotation of lever 60.

The embodiments of the invention shown in FIGS. 4 and 5 provides exercise to the operator upon both upward and downward rotation of handle 66. The operation of the exercising device is as follows. Assuming that lever 60 is located in its uppermost rotational position with members 60 and 70 abutting impact block 94, pivot points 77 are located vertically below spring 80.

The rotation of lever 60 about the fulcrum point located at pin 64 is against the spring tension of spring 80 until pivot points 77 are vertically aligned with spring 80. Continued downward rotation of lever handle 66 moves pivot points 77 above spring 80, as shown in FIG. 5, and the spring tension restraining downward movement of lever 60 is changed to a spring tension aiding the downward movement. Thus, the spring force is added to the operator's force applied at handle 66 and members 68 and 70 are rapidly rotated into contact with impact block 92. The impact force is thereupon transferred through lever 60 to the operator providing him with isometric impact exercise. It is noted that during the downward movement of lever 60 tension adjusting bolt 88 moves longitudinally with respect to frame 62 and links 74 and 76 rotate about pivot point 79.

The tension in spring 80 is adjusted by the rotation of tension adjusting bolt 88 which changes the position of threaded rod 82 within internal bore 86 of bolt 88.

Figure 6:
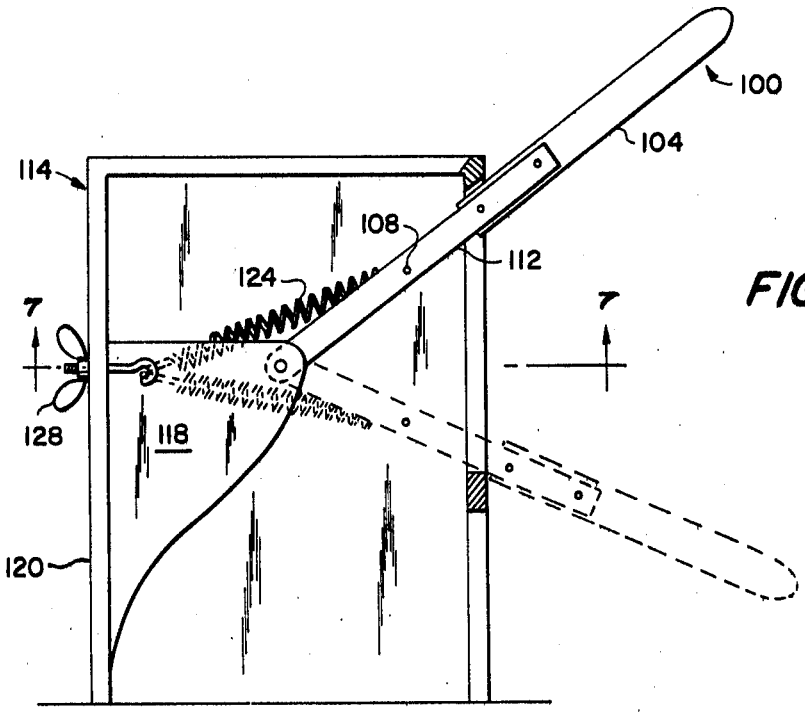
FIG. 6 is a top plan view of yet another embodiment of the invention.
Figure 7:
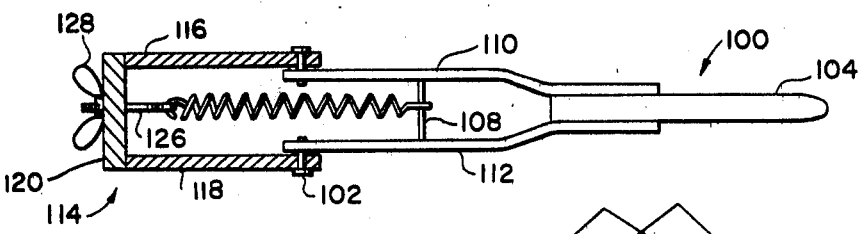
FIG. 7 is a side elevational view of the embodiment shown in FIG. 6.
Figure 8:
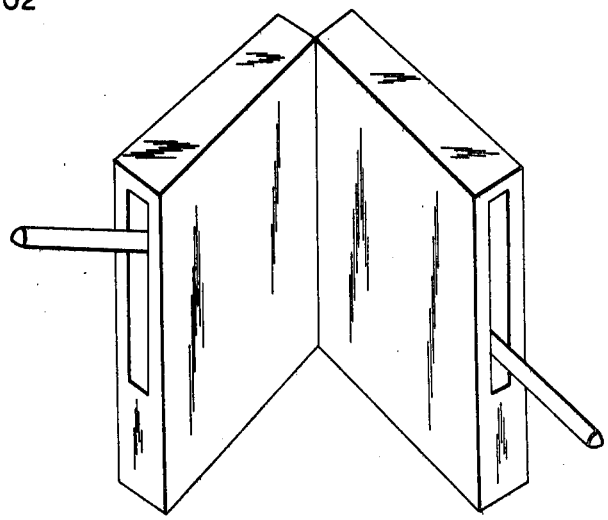
FIG. 8 is a perspective view showing two exercising devices of the embodiment shown in FIGS. 6 and 7 mounted in a folding stand.
Figure 9:
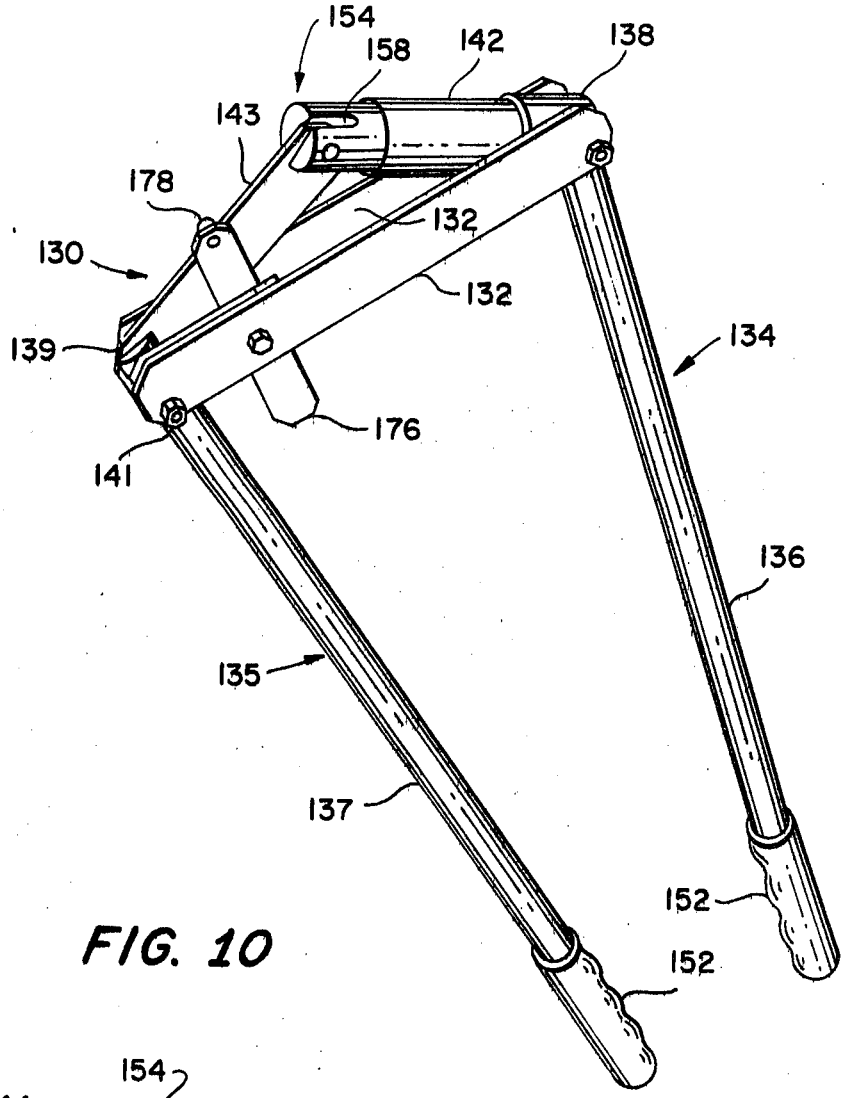
FIG. 9 is a perspective view of yet another embodiment of an exercising machine in accordance with the invention.
Figure 10:
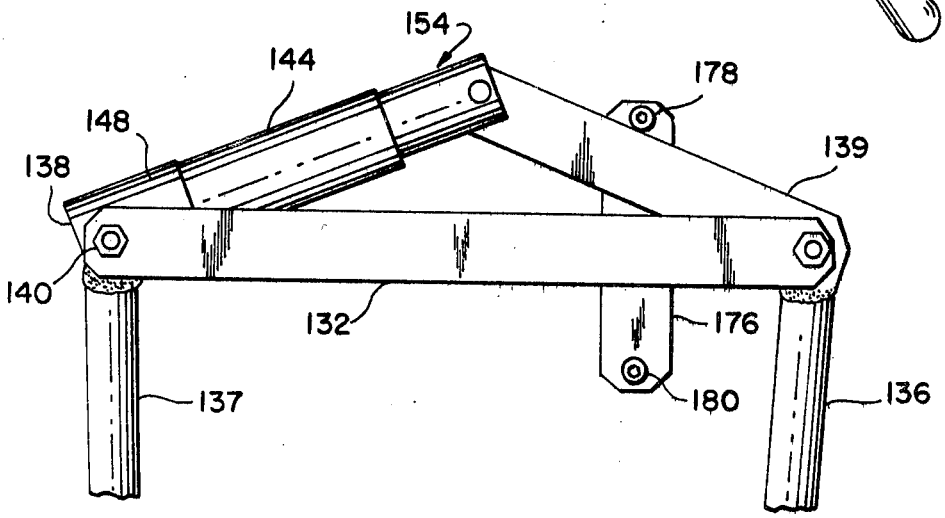
FIG. 10 is a top plan view of a portion of the embodiment shown in FIG. 9 whereby the handles of the exercising machine are in a first position.

A third embodiment of the present invention is shown in FIGS. 6 through 8 in which a third class lever is employed. A bifurcated lever 100 has a fulcrum point 102 located at one end thereof, a handle 104 on which an operator applies a force, and a transverse pin 108 located between fulcrum 102 and handle 104 and to which a force resisting means can be attached. Lever 100 further comprises arms 110 and 112 which are attached at one end thereof to handle 104 and extend substantially colinearly therefrom. The exercising device of this embodiment further comprises a frame 114 which includes gusset plates 116 and 118 extending parallel from a back plate 120. Attached to the upper corners of gusset plates 116 and 118 are arms 110 and 112 respectively. Frame 114 further includes an impact block 122 mounted on the front end of frame 114 a vertical distance below and a longitudinal distance from fulcrum 102.

The force resisting means comprises a coil spring 124 which is pivotally mounted at one end to transverse pin 108 and which is mounted at the other end to a hook shaped pin 126. Pin 126 is mounted on back plate 120 of frame 114 at a vertical distance substantially equal to the vertical distance of fulcrum 102 and is retained in place by a winged nut 128. As can be readily seen, the tension on spring 124 can be adjusted by adjusting winged nut 128.

The operation of the embodiment of the invention shown in FIGS. 6 through 8 is substantially the same as the operation of the embodiment of the invention shown in FIGS. 4 and 5. It is further noted that a second impact block can be mounted on frame 114 vertically above impact block 122 so that the exercising device can be used by rotating lever 100 in either an upward or a downward direction.

FIG. 8 depicts two exercising devices mounted in respective frames which are hinged together. With this particular type of device, an operator can exercise both limbs at the same time.

FIGS. 9 through 13 depict a fourth embodiment of the present invention in which two coupled first class levers are employed. In this fourth embodiment of the invention, an exercising machine 130 comprises a bifurcated frame 132 and a pair of substantially L-shaped, rigid, first class levers 134 and 135. Levers 134 and 135 respectively comprise elongate handles 136 and 137, vertices or fulcrums 138 and 139 which are respectively pivotably mounted to frame 132 with pins 140 and 141, and respectively further comprises base members 142 and 143. Base member 142 is comprised of an elongate cylindrical section 144 having a bore 146 therein. Base member 142 further comprises a solid end plug 148 having an annular rim 150 which receives and is rigidly secured to the end of section 144. Finally, handles 136 and 137 can be equipped with handle grips, as depicted at 152 in FIG. 9, for permitting easy and comfortable gripping of levers 134 and 135.

Figure 11:
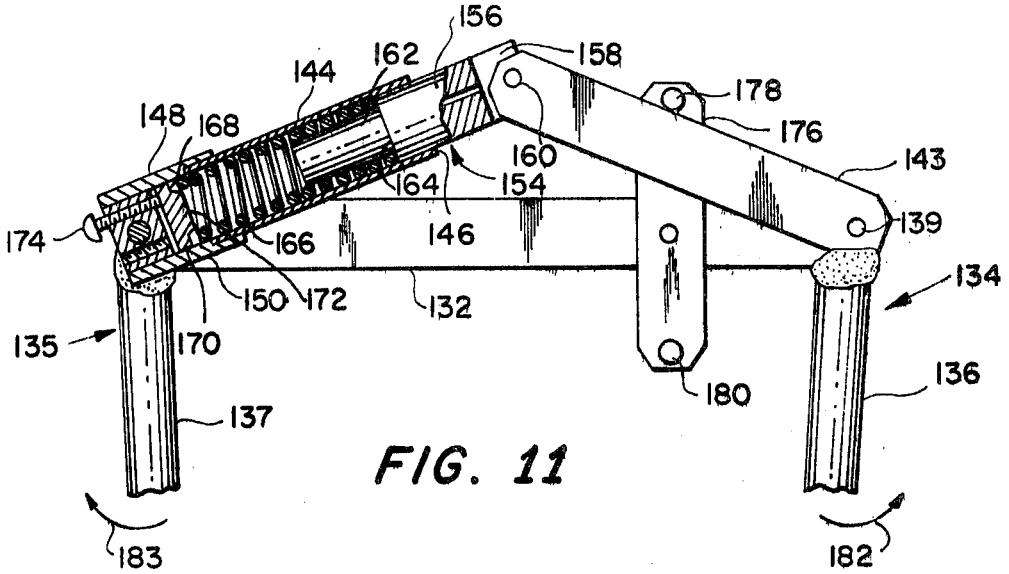
FIG. 11 is a top plan view similar to FIG. 10, but with portions removed to show internal features of the embodiment.

Exercising machine 130 further comprises a coupling means 154 for couplng lever 134 with lever 135 such that upon the rotation of one of the levers, the other lever will similarly be rotated. Alternatively, coupling means 154 can be viewed as requiring the simultaneous operation of levers 134 and 135. With reference to FIG. 11, coupling means 154 comprises a cylindrical member 156 having a notch 158 in one end thereof. The end of base member 143 distal from vertex 139 is pivotably mounted in notch 158 with pin 160. The other end of cylindrical member 156 is comprised of a solid plug 162 having a reduced diameter such that an annular ridge 164 is produced at the juncture with the main body of cylindrical member 156. The external diameter of cylindrical member 156 is such that it can be slidably received within bore 146 of section 144.

The force resisting means of exercising machine 130 comprises a cylindrical compression spring 166 that receives at one end thereof plug 162 of coupling means 154 and that receives at the other end thereof a base plug 168. Base plug 168 comprises a disc shaped cap 170 and a cylindrical retaining boss 172 integral with cap 170. An adjustment screw 174 extends into end plug 148 and bears against the end of base plug 168. Thus, adjustment screw 174 can be used to adjust and vary the compression of spring 166.

A travel restricting means comprised of restricting member 176 is rigidly mounted in a transverse direction onto frame 132. At each end of restricting member 176 are bosses 178 and 180 protruding outwardly therefrom in the direction of base member 143 of lever 135. Thus, the travel of lever 135, and hence lever 134, is limited in the clockwise and counterclockwise rotation of lever 135 by boss 178 and 180, respectively.

Figure 12:
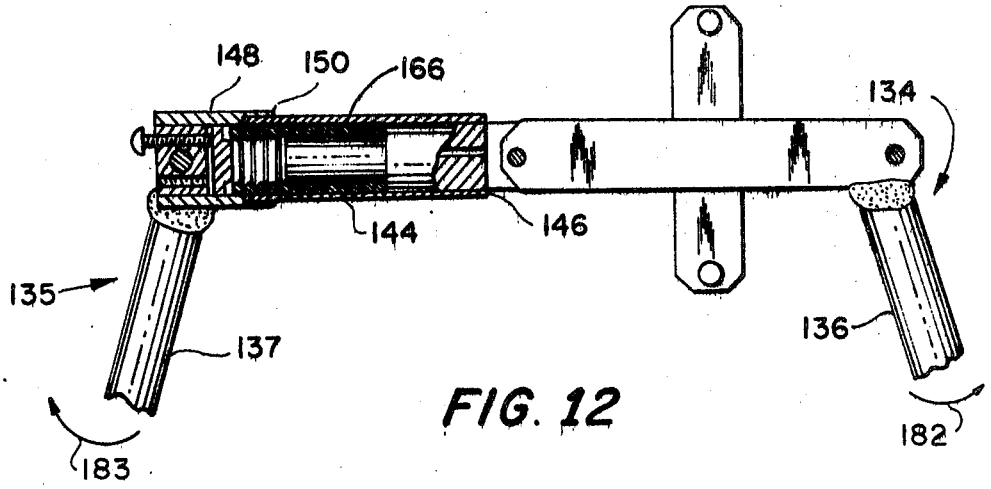
FIG. 12 is a view similar to FIG. 11, but with the handles of the exercising machine positioned such that the spring does not exert any force on the handles.
Figure 13:
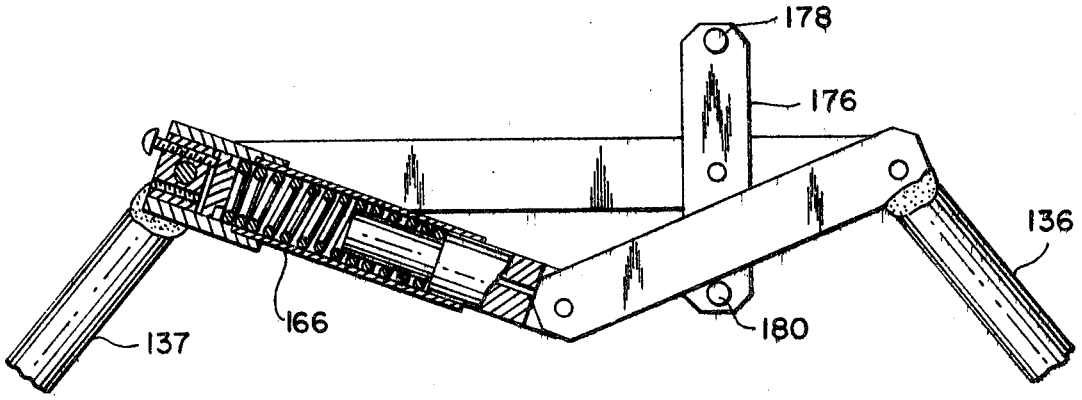
FIG. 13 is a view similar to FIG. 12, but with the handles of the exercising machine positioned in a second position.

In operation, exercising machine 130 is manually gripped with the hands of the operator placed on handle grips 152. Handles 136 and 137 are then alternatively and successively moved away from each other and then toward each other. Upon the rotation of the handles away from each other, it can be seen from FIGS. 11 through 13 that the movement of the levers is first initially opposed by the compression of spring 166 as base member 143 pushes coupling means 154 toward base plug 168. Upon further movement, as shown by arrows 182 and 183 in FIGS. 11 and 12, the compression of spring 166 will be at a maximum when base member 143 is in line with base member 142 (FIG. 12). Finally, as handles 136 and 137 are rotated away from each other, the resistance presented by spring 166 to further movement of levers 134 and 135 is removed. Furthermore, spring 166 now adds to the operator applied force, an additional force that tends to urge handles 136 and 137 away from each other. Thus, the rotational movement of levers 134 and 135 is aided by spring 166, whereupon base member 143 eventually strikes boss 180, imparting an isometric impact exercise on the operator. The operation of exercising machine 130 upon the rotation of handles 136 and 137 toward one another is similar to the above.

Other variations and modificatons to an exercising device in accordance with the present invention should be obvious. Some of these modifications can include having a vertically adjustable impact block, having a horizontally or longitudinally adjustable impact block, and having an impact block which does not absolutely impede the downward motion of the operating lever. The latter type impact block can, for example, be mounted on a shock absorbing means and would therefore transmit to the operator a smaller impact that would extend over a longer period of time than the impact imparted by the rigid impact blocks depicted in the drawings. In addition, the fulcrum of the operating levers can be positionable in either a vertical or a longitudinal direction to provide further adjustments for the exercising device. In the presently preferred embodiments of the invention, both first and third class levers have been depicted, however, it should be obvious that an exercising device having a second class lever could be provided with obvious variations being made to the supporting frames.

It is noted that the figures depict embodiments of the present invention designed for exercising the arms and wrists. However, with obvious alterations or modifications, a device according to the present invention can be changed for exercising the legs and feet.

Although the invention has been described in detail with respect to exemplary embodiments thereof together with some possible variations thereof, it will be understood by those of ordinary skill in the art that still further variations and modifications may be effected within the scope and spirit of the invention.

What is claimed is:

1. A method for exercising the limbs of the body employing the principle of isotonic exercise combined with the principle of isometric impact exercise, the method comprising:

continuously applying a force to a lever with the limb of the body to be exercised and operating said lever in a selected direction against a force resisting means for applying a force resisting the movement of said lever;

changing the amount of resistance of said force resisting means during the uninterrupted operation of said lever in said selected direction so as to permit said lever as a result of said applied force to travel more rapidly in said selected direction;

impeding the travel of the rapidly travelling lever with a travel restricting means for restricting futher travel of said lever; and sequentially repeating the above steps.

2. A method as claimed in claim 1 wherein said force resisting means is adjustable and further including initially adjusting the force of said force resisting means.

3. A method as claimed in claim 2 wherein said lever is released from said force resisting means after a predetermined amount of lever travel.

4. A method as claimed in claim 1 wherein said method further comprises simultaneously applying a force to two levers with two limbs of the body to be exercised and simultaneously operating each said lever against force resisting means, releasing each said lever from said force resisting means, impeding the travel of the travelling levers with travel restricting means and sequentially repeating the above steps.

5. A method as claimed in claim 1 wherein said changing step comprises removing said force resisting means from resisting the travel of said lever in said selected direction so as to permit said lever to travel rapidly unimpeded by said force resisting means.

6. A method as claimed in claim 5 wherein said impeding step comprises stopping the travel of said rapidly travelling lever with said travel restricting means.

7. A method as claimed in claim 6 wherein said removing step comprises removing said force resisting means from resisting the travel of said lever after a predetermined amount of lever travel.

8. A method as claimed in claim 5 wherein said force resisting means is adjustable and further including initially adjusting the force of said force resisting means.

9. A method as claimed in claim 1 wherein said impeding step comprises stopping the travel of said travelling lever.

10. A method as claimed in claim 1 wherein said changing step comprises automatically changing the amount of resistance of said force resisting means.

* * * * *